US007665734B2

(12) United States Patent
Williams

(10) Patent No.: US 7,665,734 B2
(45) Date of Patent: Feb. 23, 2010

(54) GAME AND THE METHOD OF PLAYING THE GAME

(76) Inventor: Russell B. Williams, 22824 Margarita Dr., Woodland Hills, CA (US) 91364

( * ) Notice: Subject to any disclaimer, the term of this patent is extended or adjusted under 35 U.S.C. 154(b) by 2 days.

(21) Appl. No.: 11/576,847

(22) PCT Filed: Mar. 31, 2006

(86) PCT No.: PCT/US2006/011827

§ 371 (c)(1),
(2), (4) Date: Feb. 26, 2008

(87) PCT Pub. No.: WO2006/115691

PCT Pub. Date: Nov. 2, 2006

(65) Prior Publication Data

US 2008/0265507 A1 Oct. 30, 2008

Related U.S. Application Data

(60) Provisional application No. 60/673,948, filed on Apr. 22, 2005.

(51) Int. Cl.
*A63F 3/00* (2006.01)

(52) U.S. Cl. ..... 273/251; 273/252; 273/253; 273/254

(58) Field of Classification Search ..... 273/251, 273/252, 253, 254
See application file for complete search history.

(56) References Cited

U.S. PATENT DOCUMENTS

| | | | | | |
|---|---|---|---|---|---|
| 1,476,175 | A | * | 12/1923 | Perkins | 273/252 |
| 3,638,946 | A | * | 2/1972 | Bain | 273/254 |
| 3,658,337 | A | * | 4/1972 | Peters et al. | 273/254 |
| 4,784,394 | A | * | 11/1988 | Sumin | 273/251 |
| 4,809,987 | A | * | 3/1989 | Dvorak et al. | 273/254 |
| 5,013,048 | A | * | 5/1991 | Turner | 273/242 |
| 5,183,258 | A | * | 2/1993 | Lerke | 273/252 |

* cited by examiner

*Primary Examiner*—Vishu K Mendiratta
(74) *Attorney, Agent, or Firm*—Connolly Bove Lodge & Hutz LLP; Billy A. Robbins

(57) ABSTRACT

A board game which represents a predetermined geographic area including a plurality of cites which a plurality of players may visit. The players may enter and exit the predetermined area through various entrances and exits and a plurality of travel routes are designated within the area along which a player may move. A player receives points determined by which area of interest and which themes related thereto exist. Various cards are provided for each player which may be used by the player during the play of the games which the cards determining the manner in which the player may move or be restricted from motion.

15 Claims, 13 Drawing Sheets

GAME AND THE METHOD OF PLAYING THE GAME

BACKGROUND OF THE INVENTION

1. Field of the Invention

The present invention relates generally to games and, more specifically, to educational travel games wherein participants may derive information relative to specific geographical locations and the points of interest situated therein.

2. Prior Art Description

Various games which relate to learning experiences particularly associated with travel and adapted for educational purposes are well known. By having participants engage in the playing of such games, information regarding a specific geographical area, the particular sights or points of interest located therein, culture and the like can be taught in a pleasureful, interactive and entertaining manner. The prior art known to Applicant in this area includes a game wherein players move along alternate routes and using alternate modes of transportation between cities within the continental United States, a game which simulates the flow of traffic through a community, a game which simulates the movements of trucks across the United States, a game which teaches the players about the world's geography or geography of a specific region of the world, and the like. Typically such games involve a board game apparatus wherein players move along routes defined on the board and are required to avoid hazards, obey traffic signs and rules, are required to learn about a specific location and then answer questions about the location and the like.

None of the prior art known to Applicant provides a game which may be interactively engaged in by a plurality of players directly within a pre-selected geographic area such as a metropolitan area, by utilizing a board which is representative of a predetermined area, or by utilization of computer-generated graphics as may be desired.

SUMMARY OF THE INVENTION

The present invention is a game and an associated method of playing that game which educates the plurality of players engaging in the game regarding the particular geographic location involved including modes of transportation available and points of interest located therein. The game includes means for defining a predetermined area within which the game is to be played including a plurality of entrances and exits. Travel routes are designated within the area along which a player may move. A plurality of points of interest disposed within the area are identified and each point of interest is assigned a plurality of travel themes associated therewith, a plurality of transport resource cards are provided for each player for use in movement along a selected travel route during a playing turn, a random selection means is used to determine how far a player may move along a particular route during a playing turn, and a plurality of scoring cards associated with each point of interest are provided with each of the scoring cards having a travel theme and scoring points assigned thereto. A scoring card is obtained by a player upon entry to a point of interest.

The method of playing the game includes the steps of defining an area over which players will travel, establishing means by which the players will travel, establishing routes along which the players will travel including nodes at selected points or selected intersections of the routes, defining points of interest within the area and establishing a plurality of travel themes for each one, selecting by chance the maximum distance a player may move along a route from one node to the next, entering a point of interest from a node adjacent thereto and collecting a scoring card associated with that point of interest having one travel theme associated therewith, collecting a predetermined number of scoring cards from different travel themes, electing to terminate the game by leaving the area along a selected exit path, and totaling the points on the scoring cards held by each player having a predetermined number of scoring cards within the same theme to determine the winner.

DESCRIPTION OF A PREFERRED EMBODIMENT

The present invention is directed to a game structure which

1. Classifies a number of target points of interest located within a predetermined area within which the game is to be played into specific travel themes with a scorecard for each travel theme assigned to a point of interest.
2. Scoring by traveling to points of interest using normally available means of travel and, upon arrival at the point of interest, selecting a travel theme scorecard.

3. An option for a player to terminate the game after collecting a predetermined number of scorecards from a predetermined number of travel themes.
4. Movements by players within the game area being controlled by available resources either supplied at the start of the game or acquired from a stack of chance cards during the course of play with a random length of movement for a player during a playing turn determined by chance with any random selection means such as dice or a spinner.

Figure 1:
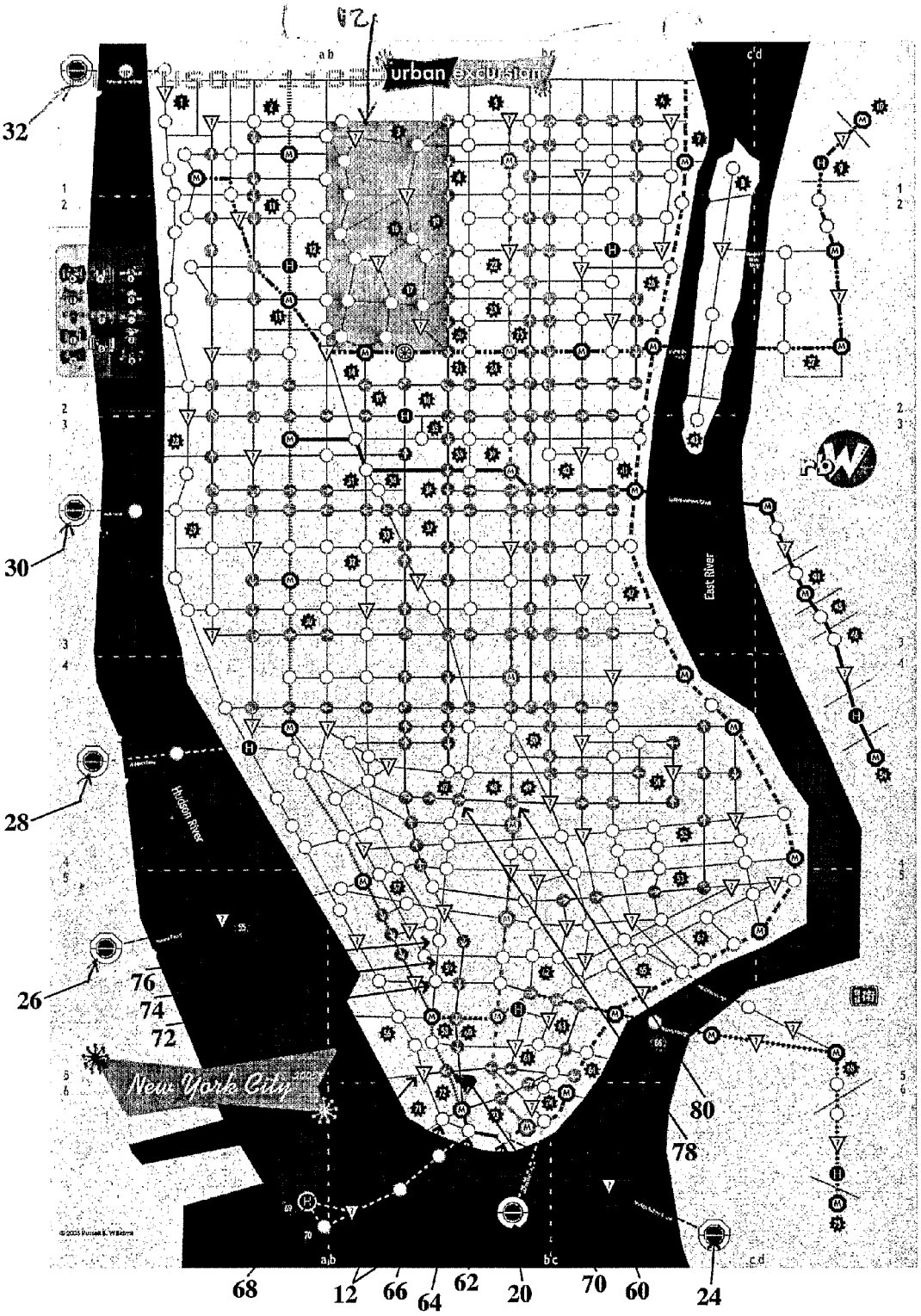
FIG. 1 is a plan view of a layout of a predetermined area within which the game may be played as one embodiment of the game designated URBAN EXCURSION NEW YORK CITY 2005.

The structure of the game is an excursion within the pre-selected area and, although as illustrated in FIG. 1, a preferred embodiment is with respect to a city such as New York City, it should be understood that other areas can be selected for the desired excursion such as sports venues, national parks, monuments, and the like. The game is developed by establishing a number of points of interest for an excursion dedicated to traveling among the points of interest to gather scoring cards divided into a number of travel themes which reflect recognizable characteristics of each of the points of interest. Although uniformity in the number of scoring cards available at each point of interest is often desirable, it is not a requirement for the structure of the game. The number of travel themes and points of interest within the pre-selected area depends on the subject matter of the game. A total score of a travel theme, the score range within a travel theme and the number of travel themes per point of interest are parameters which are established consistent with the subject matter of the game. Relative scores within a travel theme are determined based on the difficulty traveling from the location where a particular scoring card having a travel theme is available to the nearest location where another scoring card in the same travel theme is available.

Travel among the points of interest is performed by normally available travel means based on moves of random length and utilizing resources supplied at the start of the game or acquired from the stack of chance cards during the course of travel. The available means of travel are interrelated in a manner so as to maintain a realistic balance between cost and worth of using a particular travel means. Certain advantageous travel means are accessible only as the result of obtaining specified chance cards. The stack of chance cards also contain cards which provide travel difficulties. Minimum requirements to count scorecards are established for the travel themes with a prescribed number of scorecards from a prescribed number of travel themes, a player may choose to terminate the game.

In using the preferred embodiment as illustrated in FIG. 1 which is the URBAN EXCURSION NEW YORK CITY 2005, it should be noted that within the New York City area, there has been selected 75 points of interest with 25 different travel themes, each point of interest has three travel themes assigned to it. Each travel theme has nine points of interest with which it is associated. Scorecards have values ranging from 1 to 9 and 40 points are available in each travel theme. Score values are assigned depending on the distance to the nearest point of interest assigned to the same travel theme. The chosen modes of travel within the URBAN EXCURSION NEW YORK CITY 2005 are walking, bicycling, bus rides, metro rides and taxi rides. There are additional special means of travel which are available to the player from the stack of chance cards and these are helicopter rides, carriage rides and the use of an automobile.

Trading cards are provided as an option to be exercised by a player instead of a move. That is, when it becomes a player's turn, the player may choose to make a trade with another player if such can be negotiated with the other player. When the trade is completed, the player is not allowed to move and the turn of play passes to the next player. Only one offer to trade may be made within a turn. When a trade is completed, the player relinquishes his trading card but if the trade is not completed, the player keeps the playing card.

Difficulties or impediments to travel and special events in the stack of chance cards are 1. Mugging. Players may use this card to replace a turn and take any identified scoring card, transport or resource card, or Chance Card possessed by another player.
2. Police stop. Players may block the action of any other player in the game including mugging with a police stop.
3. Don't even think of parking here. A player must immediately surrender one transportation resource card as a fine when this card is drawn from the chance stack.
4. Gridlock Malfunction Movie Location, Rip off. The next turn is lost by a player who draws one of these cards.

The play of the game in its most fundamental embodiment requires three scorecards from a travel theme before they may be counted. As indicated above, however, these predetermined numbers may be changed if such is desired by the players. Also there are other embodiments of the game which require different approaches to score. After three scorecards from three travel themes are collected by a player in the most fundamental embodiment, that player has the option of terminating the game by leaving the playing area along a selected route to an identified finish point.

Referring now more particularly to FIG. 1, there is illustrated in a schematic format the city of New York. It will be recognized that the illustration which is provided is not an exact map of the city of New York and does not represent all of the streets or other travel means which are available in the city of New York. As illustrated on FIG. 1, there are 75 points of interest, each designated by a gear-shaped symbol with a number from 1 to 75 appearing therein. These points of interest are situated generally in the same positions as they are in the city of New York. The 75 points of interest which have been selected, among the many that are available in New York City are:

1. Riverside Church
2. Columbia University;
3. Lasker Rink and Pool;
4. Guggenheim Museum;
5. El Museo del Barrio;
6. Riker's Island;
7. Hellgate;
8. Roosevelt Island;
9. La Guardia Airport;
10. Yankee Stadium;
11. Children's Museum of Manhattan;
12. The Dakota;
13. Lincoln Center For the Performing Arts;
14. Hard Rock Café;
15. Carnegie Hall;
16. The Great Lawn;
17. Wollman Rink;
18. Museum of Television and Radio;
19. The Metropolitan Museum of Art;
20. FAO Schwarz;
21. Tiffany & Co.;
22. New York Doll Hospital;
23. Barney's New York;
24. LVMH Tower;
25. Citigroup Center;
26. Sotheby's Auction House;
27. The Museum of Modern Art in Queens;
28. USS Intrepid;

29. Hell's Kitchen;
30. Chelsea;
31. New Amsterdam Theater;
32. Madison Square Garden;
33. Macy's Department Store;
34. Times Square;
35. Rockefeller Center;
36. New York Public Library;
37. Empire State Building;
38. St. Patrick's Cathedral;
39. Grand Central Terminal;
40. Chrysler Building;
41. United Nations;
42. Bellevue Hospital—New York City School of Medicine;
43. Roosevelt Island Aerial Tram;
44. Shea Stadium;
45. U.S.T.A. National Tennis Center;
46. The Unisphere;
47. Washington Square Park;
48. New York University;
49. Greenwich Village;
50. Flatiron Building;
51. Stuyvesant Town;
52. Angel Orensanz Cultural Center;
53. Lower East Side Tenement Museum;
54. John F. Kennedy International Airport;
55. Holland Tunnel;
56. Skyscraper Museum;
57. New York City Fire Museum;
58. World Trade Center;
59. Tribeca;
60. St. Paul's Chapel;
61. New York Stock Exchange;
62. City Hall;
63. Federal Reserve Bank;
64. Fulton Fish Market;
65. Confucius Plaza;
66. Brooklyn Bridge;
67. Eldridge Street Synagogue;
68. Pratt Institute;
69. Ellis Island;
70. Statute of Liberty;
71. Battery Park Castle Clinton;
72. Downtown Athletic Club;
73. National Museum of the American Indian;
74. New York City Police Museum;
75. Coney Island.

It will be understood that these are only representative of many of the points of interest situated within New York City, but have been selected as a preferred embodiment of the game as being those most well known by travelers to New York City and by residents within New York City.

Figure 2:
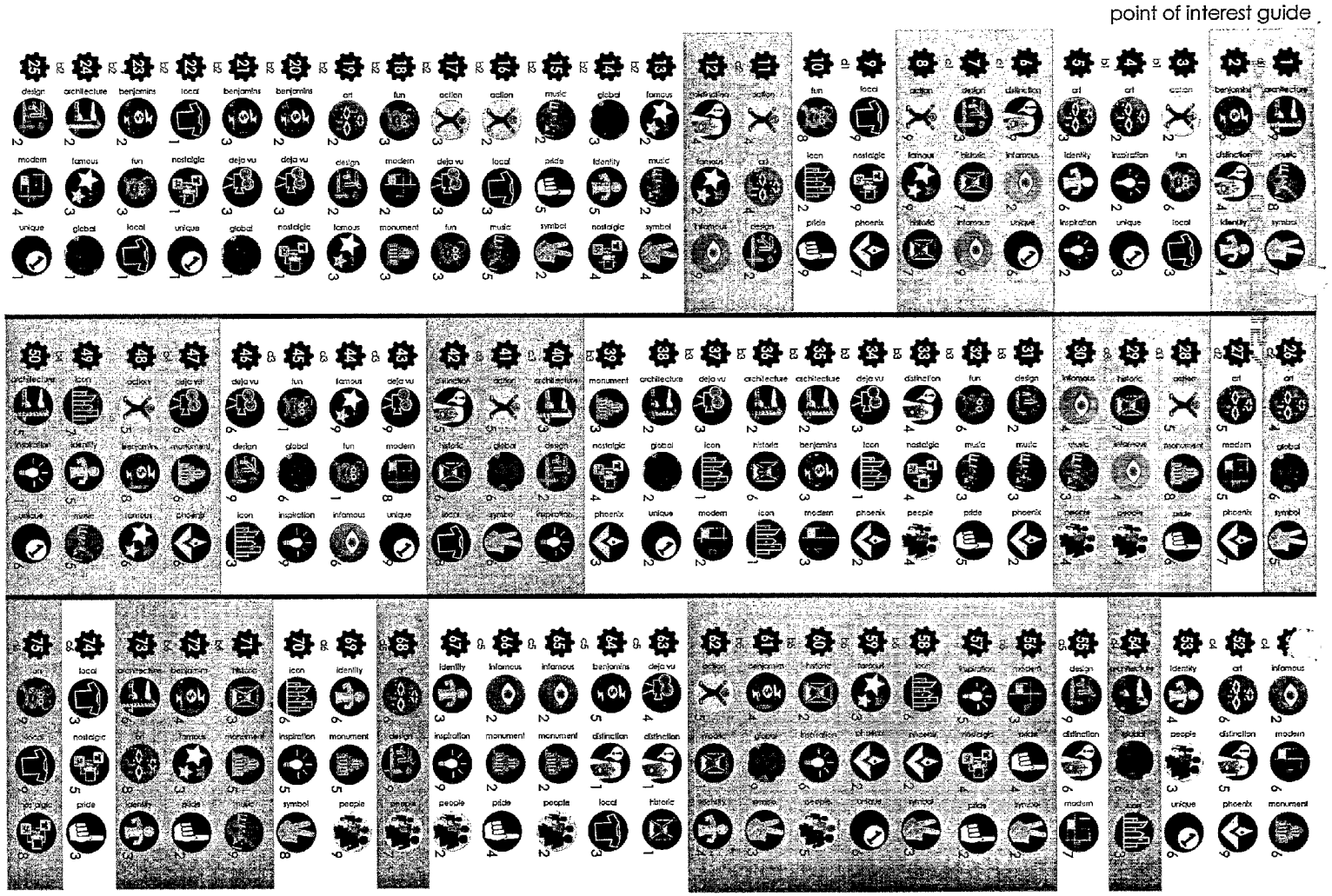
FIG. 2 is a chart which identifies each point of interest, its location within the area as designated in FIG. 1 and the travel themes associated with each point of interest.

As above indicated, each of the 75 points of interest will have a plurality of travel themes associated therewith. In the specific example of the preferred embodiment as shown in FIG. 1 representing New York City, three travel themes are associated with each of the points of interest. Reference is now made to FIG. 2 which illustrates each of the points of interest and the particular travel themes which are associated with each of the points of interest. Also associated with each of the designators for a point of interest is a map location to enable a player to locate the particular point of interest of concern on the map as shown in FIG. 1. By reference again to FIG. 1, it will be noticed that the map is divided into sectors 1 through 6 vertically and A through D horizontally. Thus, for example, the point of interest 52, Angel Orensanz Cultural Center, is located in Sector C4. It should also be noted from the point of interest guide of FIG. 2 that the Angel Orensanz Cultural Center has travel themes Art, Distinction and Phoenix associated therewith. It should also be noticed that the identical three travel themes associated with a particular point of interest such as the point of interest 52 will not be assigned to any other point of interest. For example, the travel theme Art is associated with the points of interest 4, 5, 11, 19, 26, 27, 52, 68 and 73, while the travel theme Distinction is associated with points of interest 2, 6, 12, 33, 42, 52, 55, 63 and 64 and the travel theme Phoenix is associated with points of interest 9, 27, 31, 34, 39, 47, 52, 58 and 59.

Figure 3:
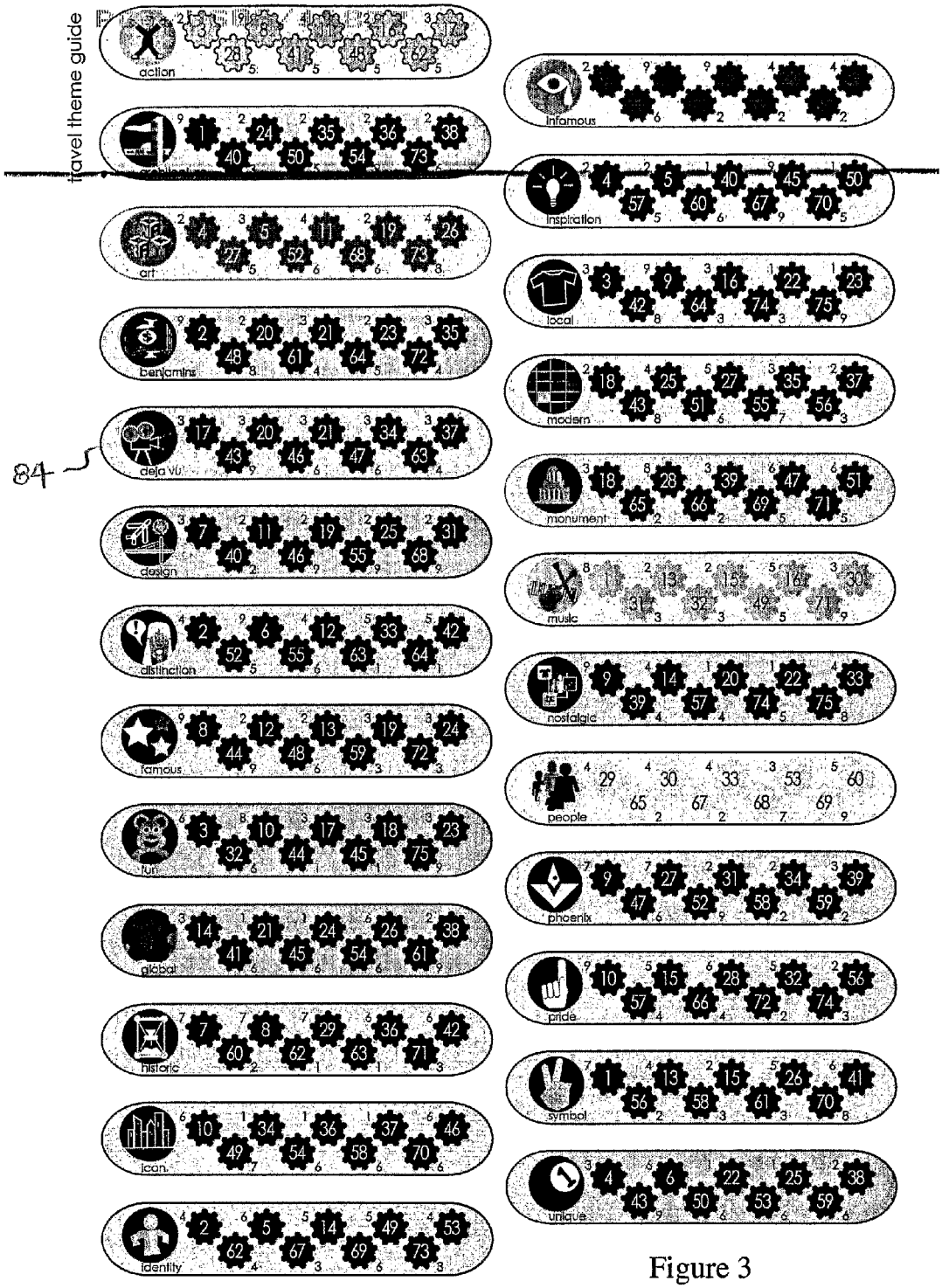
FIG. 3 is a chart identifying each travel theme and the points of interest with which that travel theme is associated and the points assigned to that point of interest and travel theme.

The travel themes and the points of interest with which they are associated are set forth on the Travel Theme Guide which is illustrated in FIG. 3 to which reference is hereby made. When a point of interest has the Action travel theme associated therewith, this means that that particular point of interest is filled with action and activity. When the travel theme Architecture is associated with a particular point of interest, it means that that point of interest is focused on an interesting structure.

If the Art travel theme is indicated, then this means that that particular point of interest is associated with artistic endeavors.

If the Benjamins travel theme is associated with a particular point of interest, it means that that point of interest is related to money and/or commerce.

The Déjà vu travel theme means that the point of interest associated therewith is familiar to the public and, particularly, to the players of the game from the depiction of that point of interest in the movies or television.

If the Design travel theme is associated with a point of interest, this indicates that the point of interest is such that function of that point of interest has inspired its form.

When the Icon travel theme is depicted, this means that that particular point of interest really is one which says to the player or the public "New York City."

The Distinction travel theme means that the point of interest with which it is associated is one which makes a debatable claim.

The Famous travel theme means that the point of interest is related to frame and celebrity.

The Fun travel theme means that the point of interest with which it is associated brings a smile to your face.

The Global travel theme is a point of interest that connects New York City to the world.

The travel theme Historic means that this is a point of interest with elements thereof which are important to history.

The Identity travel theme is a point of interest where people found a sense of self such, for example, as Columbia University and El Museo del Barrio.

The Infamous travel theme indicates a point of interest that has frame for the wrong reasons such, for example, as Riker's Island, which is North America's largest penal colony, Hell's Kitchen and Hellgate.

The Inspiration travel theme is a point of interest which touches the heart, mind or soul, such, for example, as Point of Interest 57 The New York City Fire Museum and 60 St. Paul's Chapel.

The Local travel theme is a point of interest which is primarily of interest to the city's inhabitants.

The Modern travel theme is a point of interest with products of the 20$^{th}$ Century, such, for example, as Point of Interest 18 The Museum of Television and Radio and Point of Interest 27 The Museum of Modern Art in Queens.

The Monument travel theme is a point of interest which has perpetual tributes to events and attitudes.

The travel theme Music is a point of interest which is related to music making and/or music listening.

The Nostalgic travel theme is directed to a point of interest which recalls happy memories and feelings, such, for example as 9 La Guardia Airport, 15 The Hard Rock Café or 20 FAO Schwarz.

The People travel theme is a point of interest where the people are the points of interest, such, for example, as Hell's Kitchen and 53 The Lower East Side Tenement Museum.

The Phoenix travel theme is a point of interest where things have returned to their former glory, such, for example, as the Point of Interest 31 The New Amsterdam Theater.

The Pride travel theme designates a point of interest which is associated with high standards and expectations. For example, Point of Interest 10 Yankee Stadium.

The travel theme Symbol is a point of interest which is associated with ideas that are bigger than a city, such, for example, as the Point of Interest 13 Lincoln Center for the Performing Arts or 14 Carnegie Hall.

The travel theme Unique is a point of interest that has fundamentally distinct attributes such as Point of Interest 22 New York Doll Hospital and 25 Citigroup Center.

Figures 4, 4A, 4B, 4C:
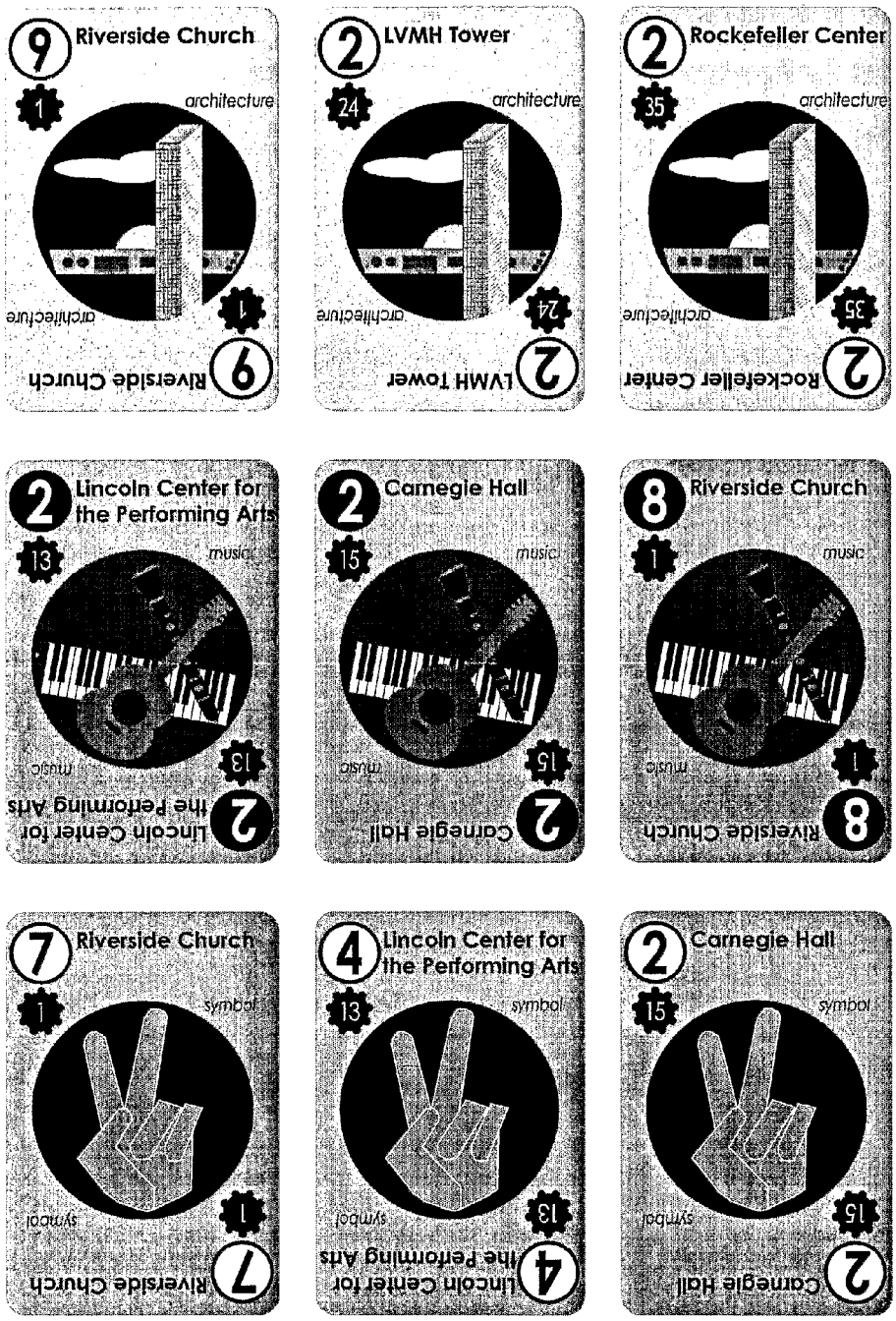
FIG. 4 is a layout of scoring cards which is representative of the plurality of scoring cards associated with each point of interest and the themes associated therewith.

As indicated above and as shown on the Point of Interest Guide, FIG. 2, each point of interest has three travel themes associated therewith. When a player arrives at a point of interest, the player may obtain a scoring card which will indicate the travel theme as well as the points which are provided by that scoring card. For example, on Point of Interest 1 as shown in FIG. 2, there is associated therewith Architecture, Music and Symbol as travel themes. As illustrated in FIG. 4 to which reference is hereby made, there is illustrated various scoring cards which are representative of the scoring cards at each of the points of interest. As one example, in FIG. 4A, the Architecture travel theme for the Point of Interest 1, Riverside Church scores 9 points. The Music symbol as shown in FIG. 4B for that Point of Interest scores 8 points, while the Symbol travel theme for that Point of Interest as shown at FIG. 4C scores 7 points. Similar scoring cards are provided for each of the other points of interest more fully as illustrated in the Point of Interest Guide FIG. 2.

As above indicated in the fundamental or basic embodiment of the game, the players' goal is to obtain three scoring cards having the same travel theme from different points of interest and to collect three score cards from three travel themes in order to terminate the game and to score. To accomplish this feat it should now become apparent that a player will utilize the map of FIG. 1 along with the point of interest guide of FIG. 2 and the travel theme guide of FIG. 3 to ascertain which points of interest the player desires to attain to be able to collect three scoring cards from the same travel theme. For example, by reference to FIG. 3, the player may recognize that the Déjà Vu travel theme shown at 84 is available at the points of interest 17, 20, 21, 34, 37, 43, 46, 47 and 63. The player will also note that at the point of interest 43 the scoring card for Déjà Vu is worth 9 points, while the scoring cards at points of interest 46 and 47 are each worth 6 points. By reference to the point of interest guide FIG. 2, the player can then see that point of interest 43 is located in Sector D3, while point of interest 46 is also located in Sector D3 and point of interest 47 is located in Sector B4. The player may then go to the map shown in FIG. 1 and locate these points of interest and thus, begin to develop a strategy of moving to these points of interest to collect the Déjà Vu travel theme scoring card from each one.

Figure 5:
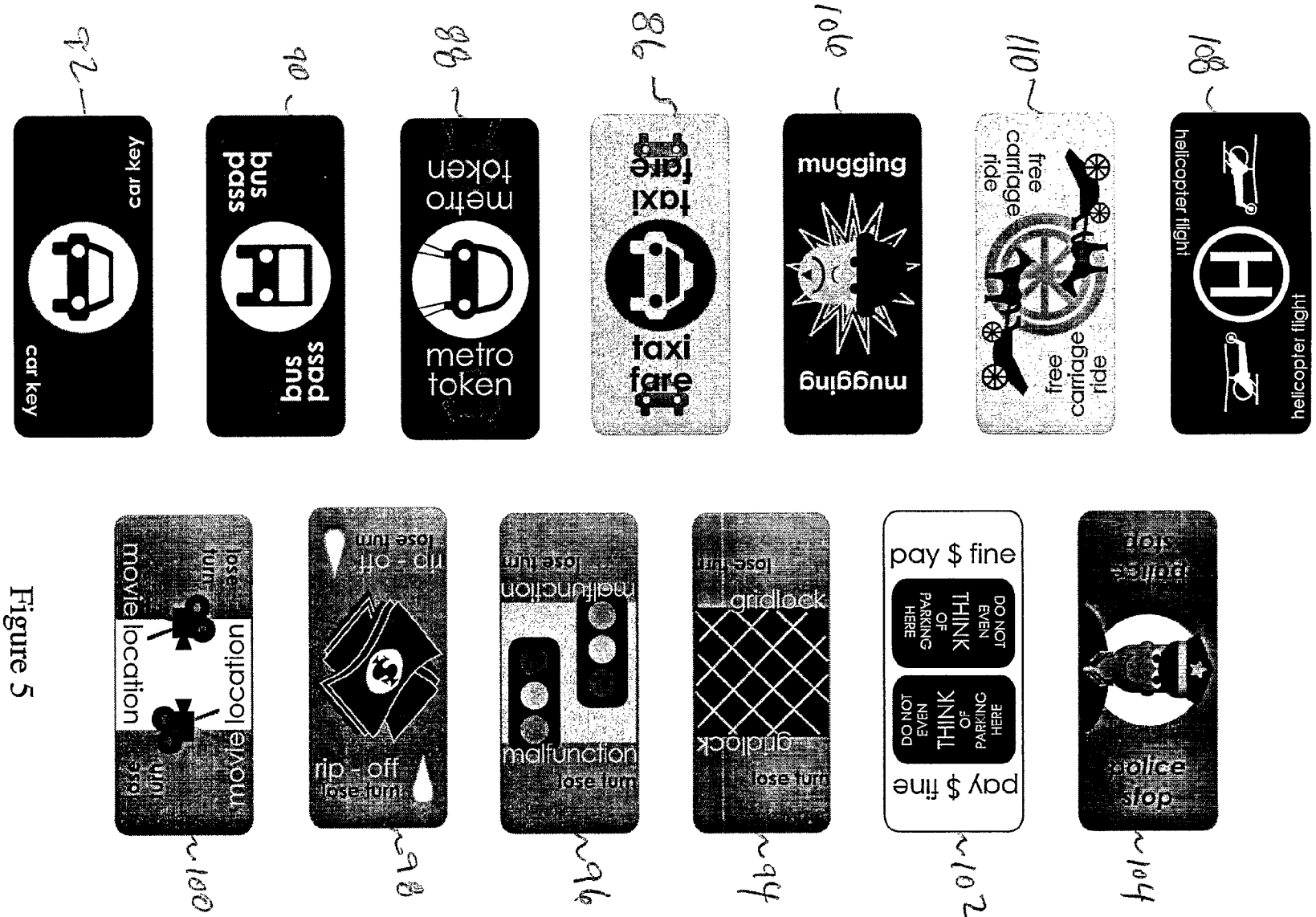
FIG. 5 is a layout illustrating the various chance cards that are available.

Referring now more particularly to FIG. 5, there is illustrated the chance cards which a player may obtain during the play of the game. As is shown therein, the chance cards include a Taxi Fare 86, Metro Token 88, Bus Pass 90, Car Key 92, Gridlock 94, Malfunction 96, Rip Off 98, Movie Location 100, Pay Fine 102, Police Stop 104, Mugging 106, Helicopter Flight 108, and Free Carriage Ride 110. The number of chance cards which are available are two Carriage Rides, four Muggings, three Bus Passes, three Taxi Fares, three Trading Cards, two Gridlocks, two Movie Locations, three Helicopter Flights, two Police Stops, three Metro Tokens, two Car Keys, two Don't Even Thinks, two Malfunctions and two Rip Offs. These cards are shuffled and placed in a stack face down so that the player cannot determine what the chance card on top is. Therefore, when the player has an opportunity to move into a position on the map to obtain a chance card, the player will have no idea what the next chance card may be. As can be seen from the chance card illustrated in FIG. 5, some of the chance cards are an asset and some of the chance cards are a detriment. For example, the Gridlock, Malfunction, Rip Off, Movie Location all require the player to lose a turn, while the Don't Even Think of Parking Here requires the payment of a fine. On the other hand, the Taxi Fare, Metro Token, Bus Pass and Car Key provide to the player the opportunity to move along the designated travel routes set forth on the map as shown in FIG. 1 utilizing one of those modes of transportation. The Helicopter Flight chance card enables the player to move from helipad to helipad on the map, while a Free Carriage Ride chance card enables the player to move from any point on the map as shown in FIG. 1 to the Carriage Ride space and then utilize the remaining moves available from that space. The Police Stop chance card enables a player to stop any action which is occurring in the play of the game, including a mugging, except for a player entering a point of interest and scoring. The Mugging chance card allows a player to take any scoring card, transport resource or chance card possessed by another player.

Figure 6:
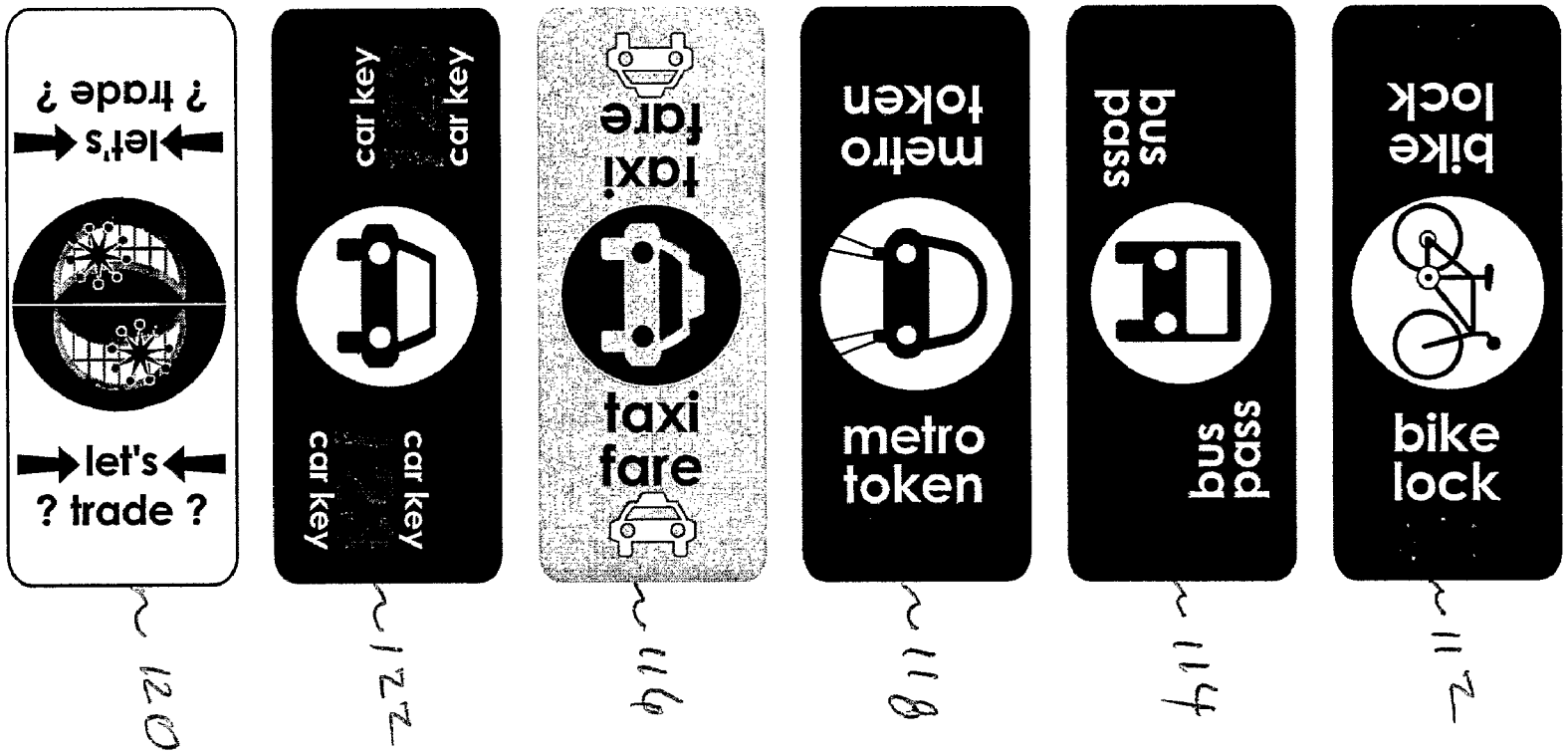
FIG. 6 is a layout illustrating the various Transport Resource cards which are provided to each player at the commencement of the game.

As illustrated in FIG. 6, there are provided transport resource cards, namely a Bike Lock 112, a Bus Pass 114, a Taxi Fare 116, a Metro Token 118 a Trading card 120 and a Car Key 122. At the commencement of the play of the game, each player is provided with three Bike Locks, one Bus Pass, one Car key, two Taxi Fares, two Metro Tokens and two Trading cards. These transport resource cards are utilizable by the players at any time during the play of the game to move along the routes of travel designated on the map as shown in FIG. 1 or to trade with other players. It should be noted that the Chance Cards 86, 88, 90 and 92 are Transport Resource Cards. A player having a trading card in the player's possession may negotiate with another player to trade for transport resource cards, scoring cards or chance cards which may be in the other player's possession. The player can make the trade only when it is that player's turn to play, and if a trade is completed, then the player is not allowed to move from the position occupied on the map during that turn. If the player is incapable of negotiating a desired trade, then the trading card may be kept by that player until the player is capable of negotiating and completing a deal with another player. Only one offer to trade can be made during a player's turn.

Figure 7:
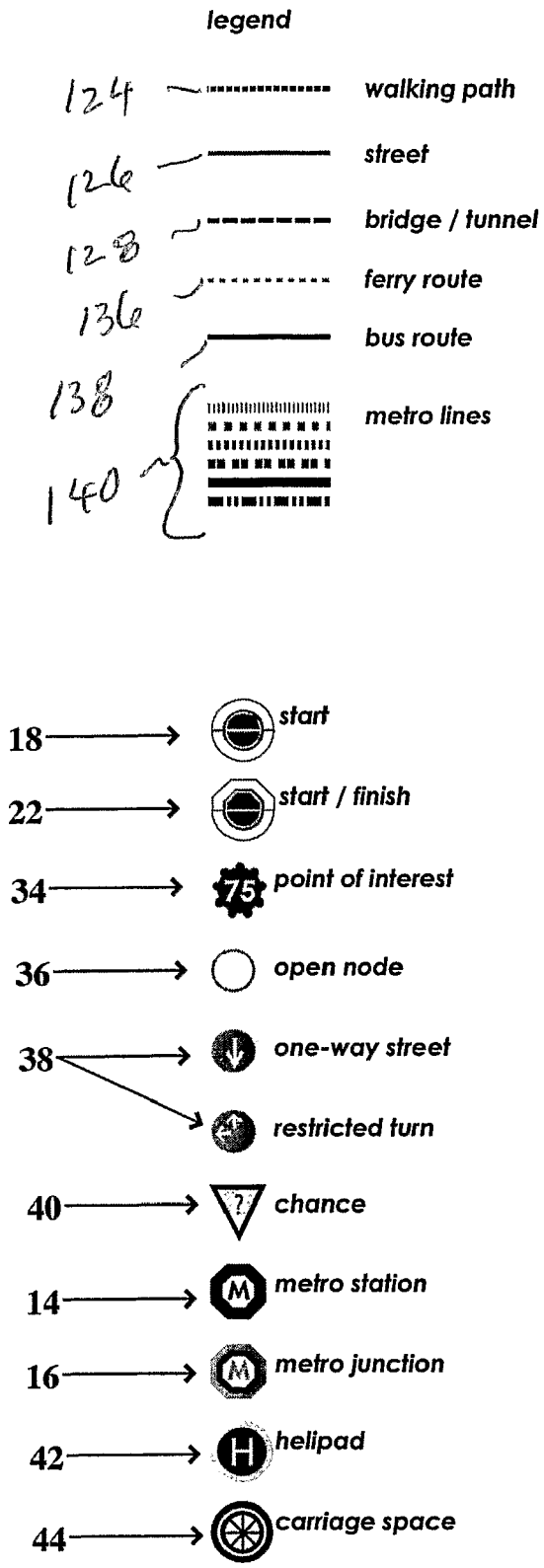
FIG. 7 is a legend explaining the various features and designations appearing within the game area as illustrated in FIG. 1.

Referring now more particularly to FIG. 7, there is illustrated a legend for the various symbols which appear upon the map as illustrated in FIG. 1. A straight dashed line 124 is a walking path and the walking paths are illustrated in Central Park which is shown at 12 on FIG. 1. When a player is moving along a walking path, the player may do so by walking and by the roll of one die or the player may do so by cycling and if that mode of travel is chosen, then the player will utilize two dice. Streets are shown on the map of FIG. 1 by simple straight lines 126 which intersect with other streets. When traveling along a city street, the player may advance by walking, cycling, taxi or car ride. When walking, the player will advance by rolling one die, cycling two dice, taxi and car rides three dice. A tunnel or bridge is designated by a heavy broken line 128 utilizing to designate the same. Again, the player may advance along a bridge or through a tunnel by walking, cycling, taxi or a car ride in the same manner as with the city street. The ferry route is designated by a relatively thin dashed line 130. There are three ferry routes, the first being the Hoboken Ferry, the second being the ferry connecting the points of interest 69 and 70 and the third is the Staten Island Ferry. The bus routes are similar to the streets, but are a darker thicker line 138. The bus routes may be traveled utilizing walking, cycling, taxi, and car rides in the same manner as the city streets but the direction of travel dictated by the arrows must be obeyed. On the other hand, the ferry routes can only be utilized by walking and cycling as was the case with the walking path.

There are six different Metro lines 140 traveling within the city of New York. Each is designated by a different symbol as shown in FIG. 6. The Metro lines have Metro stations as shown at 14 on FIG. 7 therealong and the players may advance from Metro Station to Metro Station in any direction to or from the Metro Station node while traveling on the Metro which is accomplished through the utilization of a Metro token as shown in the transport resource cards of FIG. 6. When traveling along a Metro line route, if the route intersects with another Metro line route, then a Metro junction as is shown at 16 on FIG. 7 is found. The Metro junction is indicated by an octagon having an outer ring bearing the same symbol as one of the crossing Metro lines and inner ring having the same symbol as the other Metro line. When a player reaches a Metro junction node, players can move in any direction to or from this node traveling on the Metro as long as the players move to the next same Metro Station node of either of the intersecting Metro lines.

A start only node is shown at 18 on FIG. 7 and the player can start the game on this node. There is only a single such node which is shown at 20 on FIG. 1 and the player would start on this node if desired by utilizing the Staten Island ferry intersecting with the open node at the south end of New York City. The start/finish node is illustrated at 22 on FIG. 7 and the players may either start the game or finish the game on the node 22. There are five such start/finish nodes on the map as shown in FIG. 1 as illustrated at 24 through 32.

The points of interest are all designated by a gear-shaped symbol having a number therein as shown at 34. As indicated above, there are 75 different points of interest for the urban excursion New York City 2005 game as shown in FIG. 1.

Along the various streets, walking paths, metro lines, bridges, ferry routes and tunnels, there are open nodes as shown at 36 upon which a player may land during the play of the game.

Along the streets and particularly substantially all of the bus routes there may be a designation as shown at 38 showing that a particular direction of travel must be followed on that street. In some instances, where the streets intersect then from that particular node the player may take two avenues of travel as designated by the arrows.

Along some of the routes of travel there is a chance node shown by a triangle with a question mark centered therein as shown at 40 in FIG. 7. When a player lands on a chance node, the player receives a chance card. The players can move in any direction to or from this node. However, to receive a chance card the player must land on this node utilizing all moves which are available from the roll of the dice whether using one, two or three dice as the case may be.

There are nine helicopter nodes or helipads on the map as shown in FIG. 1 and these are designated by the circle with the letter "H" contained therein as shown at 42 on FIG. 7. A player can move in any direction to or from this helipad node traveling in a helicopter which can be done utilizing a helicopter flight card which has been obtained from the chance stack. When traveling in a helicopter, the player can jump to or from one of these helicopter nodes to another during the player's turn. The number of jumps is determined by the roll of a single die.

There is one carriage space node as indicated by the symbol 44 and this carriage node is located at the bottom part of Central Park 12 as shown in FIG. 1. Players can move in any direction to or from this node. When a player obtains a Free Carriage Ride card from the chance stack, then the player having that card may use it at any time on a turn and may move directly to this carriage space node from anywhere on the map.

Figure 8:
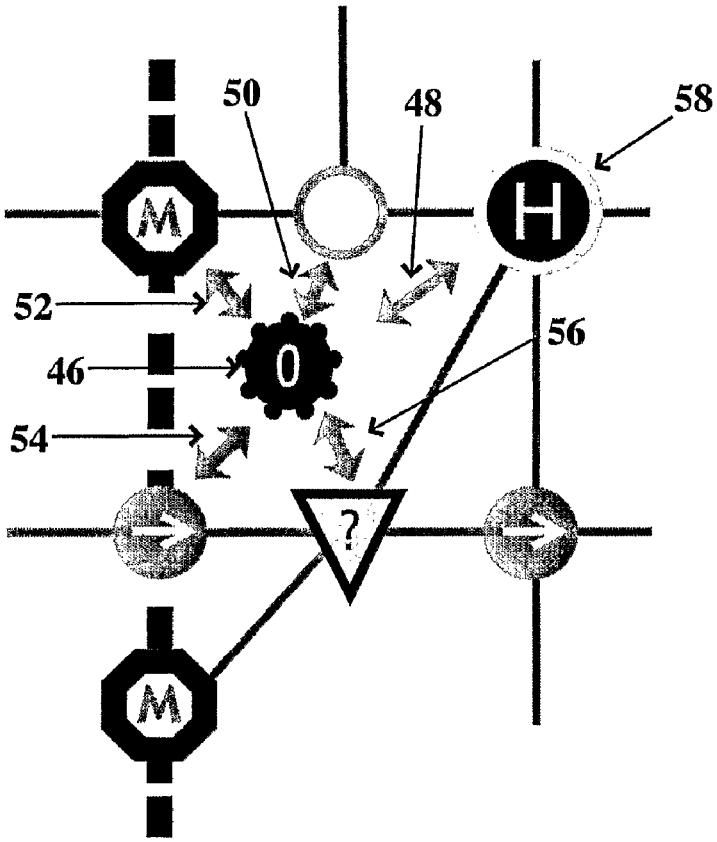
FIG. 8 is a diagram illustrating the manner in which a player may move to or from a point of interest during a playing turn.

By referring now to FIG. 8 there is illustrated the manner in which a player may move to or from a point of interest. As is therein illustrated, the point of interest is designated by the gear-shaped symbol 46 with the number "0" contained therein. As is shown by the double ended arrows 48 through 56, a player may move from the point of interest "0" to anyone of a number of nodes, for example, to the helipad 58 as illustrated by the arrow 48. Likewise, the player may move from the helipad 58 to the point of interest as also shown by the double ended arrow 48. The restrictions on movement is that the player may jump to or from a point of interest to any node which is not blocked by a street, a bus route, a Metro line, a walking path, a ferry, a tunnel, a bridge, a riverbank or another player.

Figure 9A:
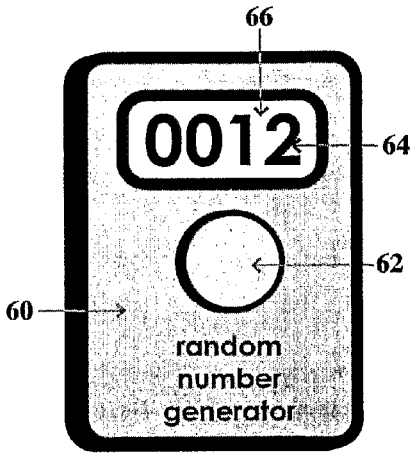
FIG. 9 is a schematic representation of random number generation means illustrating three different modes thereof.
Figure 9B:
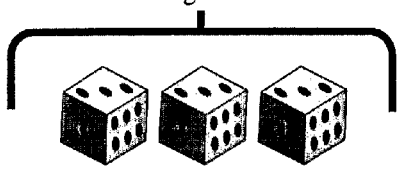
Figure 9C:
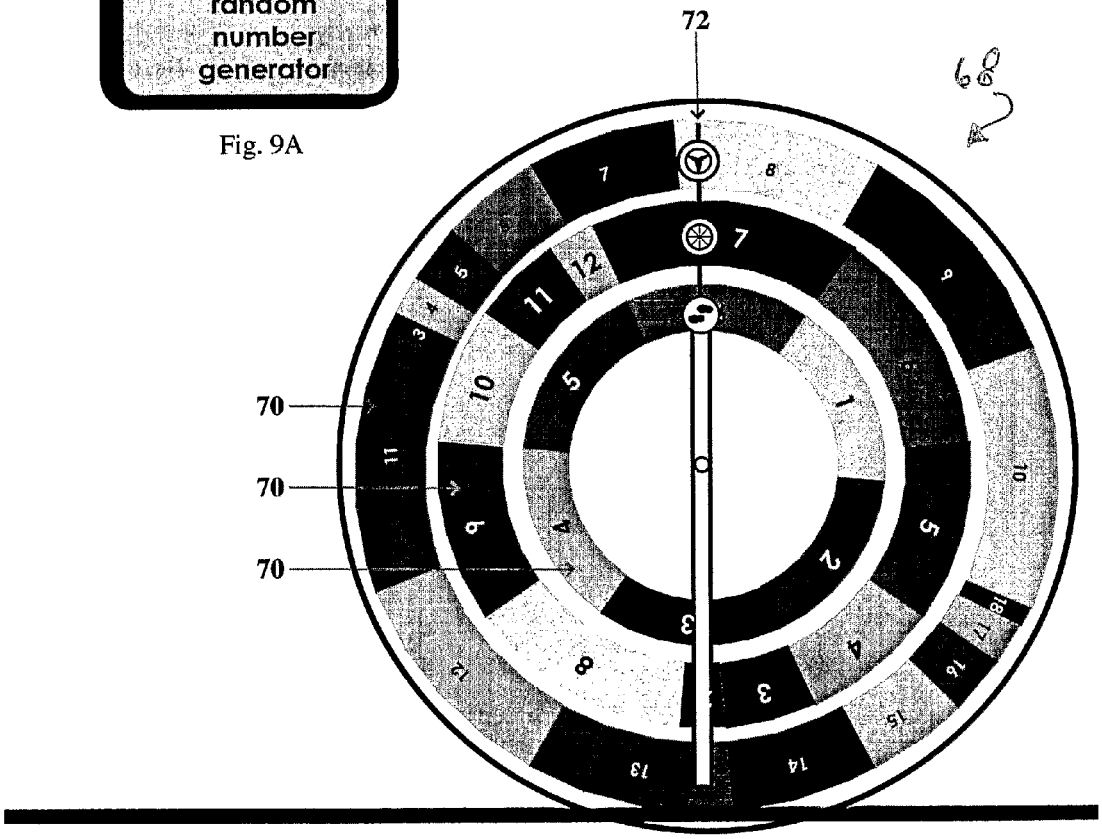

By referring now more particularly to FIG. 9 there is illustrated schematically means for randomly generating a number for use by a player to determine the number of jumps that may be made in that player's turn. The device used may be an electronic number generator 60 (FIG. 9A) which when activated such as by pushing a button 62 will cause a number 64 to appear in a window 66. Alternatively, as shown in FIG. 9B, the device may be dice. As shown, there are three dice. As above described, one, two or three dice are used depending upon the type of transportation the player elects to use during a turn. As an additional alternative, the device may be a spinner 68 as shown in FIG. 9C. The spinner will have numbers 70 positioned around the periphery and when the pointer 72 stops at a number, that will determine the number of jumps. As illustrated, the spinner may have three (3) rings of numbers with the inner most ring corresponding to one (1) die, the intermediate ring to two (2) dice and the outer most ring to three (3) dice.

Figure 10:
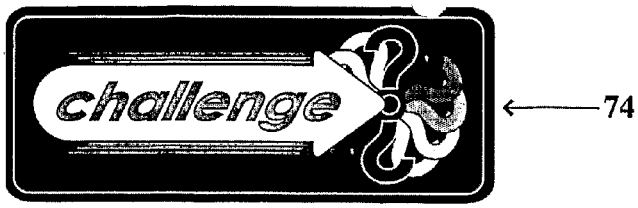
FIG. 10 is an illustration of a challenge card which may be used in a variation of the game.

FIG. 10 illustrates a Challenge Card 74 which may be used in some variations of the game as will be explained hereinafter.

Figure 11:
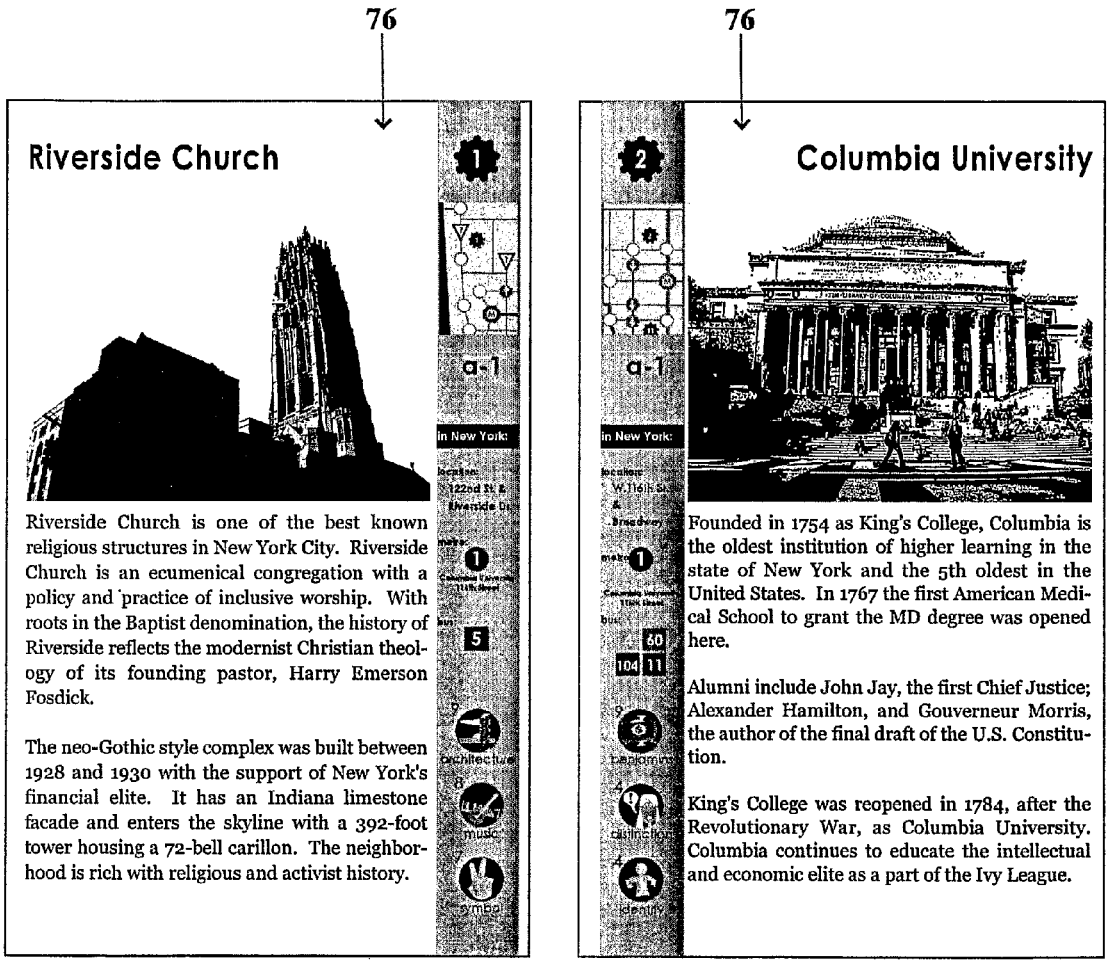
FIG. 11 is a schematic representation of a guide book which explains the points of interest and the travel themes associated therewith.

FIG. 11 illustrates schematically pages 76 from a guidebook which is included with the game. The guide book includes a pictorial illustration of each point of interest on the map and a narrative describing the features of that point of interest which assist the player in determining why certain travel themes are associated therewith. The guide book may be referred to by the players during the play of the game or otherwise for educational and entertainment purposes. However, during the variation of the game employing the challenge card, the player challenged may not refer to the guide book to explain why a travel theme on a scoring card is applicable to a particular point of interest.

Play of the Game

There are a number of variations to the EXCURSION game and the manner in which it can be played. Set forth below will be a description of the simplest manner in which the game can be played, which will be referred to as "Open Excursion." All of the rules, moves and strategies applicable to Open Excursion are also applicable to the other variations of the Excursion game which will be described below. The game will also be described in conjunction with URBAN EXCURSION NEW YORK CITY 2005 as set forth in FIG. 1 and above generally described. It should, however, be recognized that any particular area may be mapped out upon which the game can be played irrespective of its relationship to an actual geographic or other area of interest. The players will move between connected spaces on the map with the number of moves being determined randomly by a random number selector, such as the roll of dice or a spinner. For purposes of this explanation, the roll of dice will be utilized. There are three dice provided. The number of dice depends upon the method of transport which the player selects to use at the time of his turn to play. The object is to visit points of interest around the city and select a score card from a point of interest once it is visited and to obtain scoring cards within various travel themes as they are associated with various points of interest. It will become apparent as the play of the game is described below that the Excursion game is won by the player who plans his moves, adapts to the situation of other players positioning within the game, determines the most efficient navigation from point to point, the most effective use of the various travel resources, knowledge about the playing area and information about the points of interest and, of course, luck. The game is designed to be played by two to eight individuals at a time. The play can be by individual players or by players who divide up into teams.

If the players elect to divide into teams for the play of the game, then the members of a team may play as if they are a single individual or, alternatively, each member of the team may play as a separate individual. Team players are allowed to freely discuss strategy and tactics during the course of play. Team players must have at least one other person between them in the seating arrangement and rotation of play during the play of the game.

Figure 12:
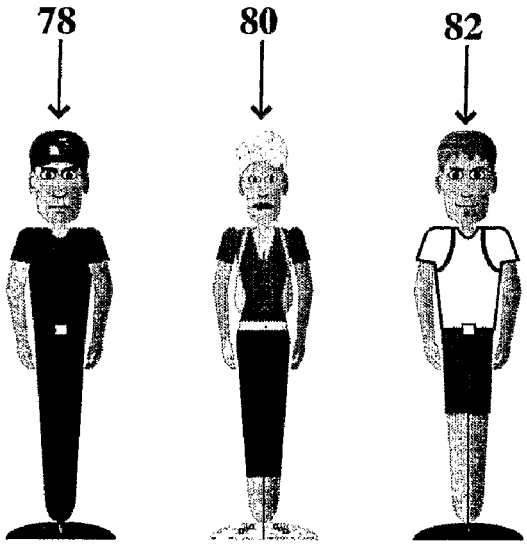
FIG. 12 is a schematic representation of pieces the players may use for moving about the map of FIG. 1.

Before play is started, the players choose a piece to represent them on the playing surface and that piece is moved from node to node along the various travel paths according to the transportation resource which has been chosen. By reference to FIG. 12, there is illustrated three such playing pieces 78, 80 and 82. These are only representative and it should be understood that any configuration may be provided so long as there are enough pieces for the number of players in the game. One person is designated as the Transportation Commissioner. All players interested in that position will roll a single die and the lowest score is appointed as the Transportation Commissioner. The Transportation Commissioner is awarded five bonus points at the end of the playing of the excursion game as consideration for functioning as the Transportation Commissioner and carrying out the duties of that position. The Transportation Commissioner distributes the initial eight transport resource cards, two trading cards, shuffles the chance cards and manages all cards during play. The Transportation Commissioner is also the judge of final appeal in any interpretation of the game play after referring in depth to the game documents. The Transportation Commissioner may be a person who is not playing with a piece on the board if such is desired.

Play will start with the person to the immediate left of the Transportation Commissioner and continue in a clockwise direction.

Each player receives three Bike Locks, two Metro Tokens, two Taxi Fares, one Bus Pass, one Car Key and two trading cards at the start of every game. The game may be started by the player immediately to the left of the Transportation Commissioner choosing to enter the playing area from any one of the six entry points, namely, the Staten Island Ferry 20, the Brooklyn Battery Tunnel 24, the Holland Tunnel 26, the Hoboken Ferry 28, the Lincoln Tunnel 30 and the George Washington Bridge 32 (FIG. 1).

For purposes of illustrating the manner in which the game is played, it will be assumed that the player immediately to the left of the Transportation Commissioner elects to commence play by entering the playing surface by utilizing the Brooklyn Battery Tunnel and commencing play from the Start/Stop node 24. Since the fundamental manner of traveling is by walking, it will be assumed that the player rolls a single die to determine the number of moves available to the player. It will now be assumed that the player's roll caused a "5" to appear on the exposed face of the die. Thus, the player will have the opportunity to move five times from one node to another node, using directly connected pathways. It should be noted to commence with, that the player must travel from the Start/Stop node 24 through the Brooklyn Battery Tunnel and cannot jump over the water. By traveling through the Brooklyn Battery Tunnel, the player will land first on the Chance node 60. However, the player cannot select a Chance Card at this point because in order to do so, the player must land on a Chance node using all moves available from the roll of the die. Thus, the player would, through utilizing the four remaining moves, be able to move to the next connected node 62. The player at this point has the option of moving to the node 64 or 66 and then to the Chance node 68. If that election is made, then the player would land upon the Chance node 68 by utilizing all of the five available moves allowed from the roll of the die. This would enable the player to select a Chance card if such is desired. If such is done, however, the player must recognize that he has 4 chances out of 13 of losing a turn and, thus, this should definitely be considered, particularly early in the game. Another option is for the player to elect at either nodes 62, 64 or 66 to enter one of the points of interest available, namely, 71, 72 or 73. Since the object of the game is to enter the points of interest and collect scoring cards, the player must give this some consideration. By reference to the Point of Interest Guide, FIG. 2, the player can note that the point of interest 72 is accessible from the node 66 and as above pointed out, the player may use the last turn to enter the point of interest and select a playing card. Assume the player elects this option and obtains the playing card having the travel theme Famous from the point of interest 72. Since the player has entered the point of interest and selected the scoring card, the player's turn would end even if the player had not utilized all of the moves. It should be recognized that the player could have elected at either node 62 or 64 to enter the point of interest 73 thus terminating the player's turn even though the total of five moves had not been completed.

Assume now that the other players have had their turn and have entered the playing area in a manner similar to that above described with the first player. The subsequent players may enter the playing area from any one of the Start/Stop nodes and may, in fact, enter from the same node 24 for the Brooklyn Battery Tunnel as did the first player. Assume now that it is the original player's turn again, recognizing that this player is at point of interest 72. The player will consult the point of interest Guide as shown in FIG. 2 to determine whether there is another point of interest that can be accessed from the point of interest 72 which has the Famous travel theme associated therewith. By investigating the Travel Theme Guide, FIG. 3, it can be seen that the Famous travel theme is applicable to points of interest 8, 12, 13, 19, 24, 44, 48, 59 as well as 72. The player, thus, can see that the point of interest 59 is located on the map in the sector B5 which is immediately above the location of the sector of the point of interest 72 which is in B6. Therefore, the player can elect to roll die for walking again. Assume upon this roll of die that the number "6" comes up. Such being the case, the player can leave the point of interest 72 by moving to the one-way node 70. It will be remembered that the player can cross the one-way node or follow the direction of the arrow as desired. Under these circumstances, since the player is intent on reaching the point of interest 59, the player would continue along the metro line and the street to the node 72 from which the player could then enter the point of interest 59. It will be recognized that five moves have been made at this time, but such is permissible since there were six moves available and the player is not required to use all of such moves. Upon entering the point of interest 59, the player may then select the second Famous travel theme scoring card.

Again assume that the other players have made their moves and it is again the original player's turn. The original player again will consult the Point of Interest Guide and the Travel Theme Guide to determine whether there is another point of interest which may be reachable which also has the Famous travel theme associated therewith. As a result of such consultation, it can be determined that the point of interest 48 located in the sector B4 meets this criteria. The player can again decide to walk and will roll the die to determine the number of moves available. The player will then again determine to utilize walking as a mode of travel and will roll the die. Assume that the die comes up "4." Under these circumstances, the player will move from the point of interest 59 back to the node 72 and then will go directly north along the street 74, which will take the player to the node 76. The player will then again have to wait until his turn comes up, make another roll which we will assume is again a "4." Under these circumstances, the player can move directly up to the node 78 and from there to the point of interest 48, where an additional Famous scoring card can be secured. The player now has three scoring cards, each of which are from the same travel theme, namely, Famous.

The player on additional turns would through a similar process settle upon a strategy for acquiring three different travel themes from different points of interest. For example, the player could leave the point of interest 48 and elect to utilize the adjacent metro line 80 and travel to the sector B3 to the point of interest 38 and from there to the points of interest 22 and 25 and collect travel themes Unique associated with those points of interest. By continuing similarly to strategize and carry out the appropriate strategy and tactics, the player would then collect scoring cards with the same travel theme from three additional points of interest, thus placing the player in a position to terminate the game by leaving the site and traveling to one of the Start/Stop nodes.

Obviously, the other players would be utilizing the Point of Interest Guide and the Travel Theme Guide to accomplish the same thing as quickly as possible so as to place them in a position to score as many points as possible and win the game.

Although only walking and a ride on the metro line has been discussed above, it will be recognized that the players can use the other transport resources available to them for travel within the designated area. For example, the player may utilize a Bike Lock travel resource card, declare that he is doing so prior to the roll of the dice, and then utilize the bicycle travel along the various routes set forth but obeying all of the rules. The distance of the bike ride is determined by the roll of two dice.

Alternatively, the player may declare in advance that he wishes to use a Taxi Fare Card which will enable the player to then move from any space except those on walking paths or ferry routes. The player will roll three dice to determine the distance of the ride. The ride must follow traffic restrictions and avoid opponent locations. Similarly, the player may use a Bus Pass and follow any connected bus route. However, the player must be positioned on a bus route or one space away from the bus route before they can declare their intention to take the bus. In riding the bus, a player can cross an opponent's location but cannot stop at an opponent's location. Choosing to end the ride before the number of moves and the roll are used, the player can make one additional move off of the bus route.

As above pointed out, the player during the play of his turn may land upon a Chance node and, if such is done within the exact number of moves specified by the dice, then the player may select a chance card from the stack. The chance card may provide additional advantages to the player in that the player may obtain an additional Taxi Fare, Metro Token or Bus Pass and, in addition, may obtain a Car Key, a Helicopter Flight or a Free Carriage Ride. The player also may obtain a Mugging chance card or a Police Stop chance card. Through utilization of the Mugging Card, the player may interfere with another player's play of the game by taking away from that player any scoring card, transport resource or chance card possessed by that player. The mugging happens during the turn of the player which has the Mugging card in his possession. The mugger must identify exactly what they are attempting to take from their opponent. Whether the mugging is successful or not, the Mugging card is returned to the Commissioner for recycling. If, while the attempt to mug is being accomplished, the player who is being mugged has a Police Stop card, the player may utilize that card to stop the mugging. The Police Stop card can also be utilized to block the action of any other player in the game. It can stop any action including all types of movement as well as the mugging. The Police Stop cannot prevent another player from entering a point of interest and scoring. The Police Stop must be played after the dice are rolled or a transport resource or chance card is played. It can thus be seen that other players, if they have been successful in acquiring Mugging or Police Stop chance cards, may utilize those to stop the action of any player during the player's turn, thus interfering with that player's ability to obtain scoring cards.

If a player while ending on a chance mode is lucky enough to receive a Car Key chance card then the player can use that card to drive around the city for three consecutive turns. The length of each ride will be determined by the roll of three dice. The player in traveling around the city must obey street restrictions and rules and the player cannot travel on walking paths or ferry routes. Players can use the last move in the roll to enter a point of interest or the first move to exit. Landing on chance and drawing a penalty card while driving means that the right to drive is lost.

Additional modes of travel which may be acquired by having the luck of drawing a chance card is a helicopter flight. The player can move between any two of the helipads on the map as shown in FIG. 1 with this card. The flight equals one move in a roll. Players can take the remaining moves after landing or before taking off.

There is also the availability of a Carriage Ride. A player if he draws the chance card for the free carriage ride can move directly to the carriage ride space at the southern end of Central Park from anywhere and whenever they want with this card. The ride equals one move in a roll of the dice. Players can take the remaining moves from the carriage ride space by walking.

The first player who elects to leave the playing area is awarded eight bonus points. Once the player has elected to leave town and thus end the game requires points on the scoring cards to be totaled for each player who has at least three cards in a travel theme. The one who has the largest number of points is the winner of the game. Where there is a team playing as multiple individuals as above referred to, the team cannot end the game until all team members have enough scoring cards to leave town and all have successfully left town. When such occurs, the scoring cards within travel themes are then combined and divided by the number of team members to determine the team score. The team with the largest number of points is the winner of the game.

An optional method of scoring may be adopted by the players upon their agreement prior to the start of the game. Utilizing this optional method, additional points are awarded for the collection of scoring cards within a theme that have the same value or form a straight, that is consecutive number sequences. Following this option if a player collects scoring cards within a theme where three cards having the same score are held, then the score is doubled. If the player collects five theme cards having the same score, then the score is tripled. If a player collects theme cards from the same theme in which the consecutive numbers are four in a row, then the score is doubled. If on the other hand the player collects theme cards with a score on there which are five consecutive numbers in a row, then the score is tripled.

As an alternative manner of playing the game, the players may receive three Challenge Cards 74 (FIG. 10) in addition to their eight transport resource cards and two trading cards at the start of the excursion. During a player's turn when that player lands on a point of interest and claims a scoring card from that point of interest, another player may utilize one of his Challenge Cards to challenge the claim which is being made by the player with regard to the theme for that point of interest. The challenger must give his Challenge Card to the Transport Commissioner and put one scoring card into full view of all of the players. The challenger then asks the player who has made the claim for the scoring card to explain why that point of interest is within the travel theme they are claiming.

The player who is making the claim for that travel theme from that point of interest must then provide an appropriate explanation as to why the travel theme is associated with that point of interest but he cannot refer to the travel guide 76. The challenger then has an opportunity to either accept or reject the explanation. If the challenger accepts the explanation then both players keep their scoring cards. If the challenger however rejects the explanation then other players in the game vote to either accept or reject the explanation. The challenger however must first give a short explanation for the rejection of the explanation given by the player who has claimed the travel theme. If the other players vote to reject the explanation, then the scoring card being claimed by the player as associated with that point of interest goes to the challenger. If the other players vote to accept the explanation, then the challenger's revealed scoring card is given to the player who has claimed the scoring card for that travel theme associated with that point of interest. The Transportation Commissioner whether playing with a piece on the board or not gets a single vote with the other players. In the event of tie vote, the challenger and the claimer will play one round of rock, paper, scissors on the count of three. As is traditional in this game, paper beats rock, rock beats scissors, scissors beats paper. The winner takes the scoring card from the loser. The other aspects of playing the game as above outlined apply to the play of the game with the challenges.

Figure 14:
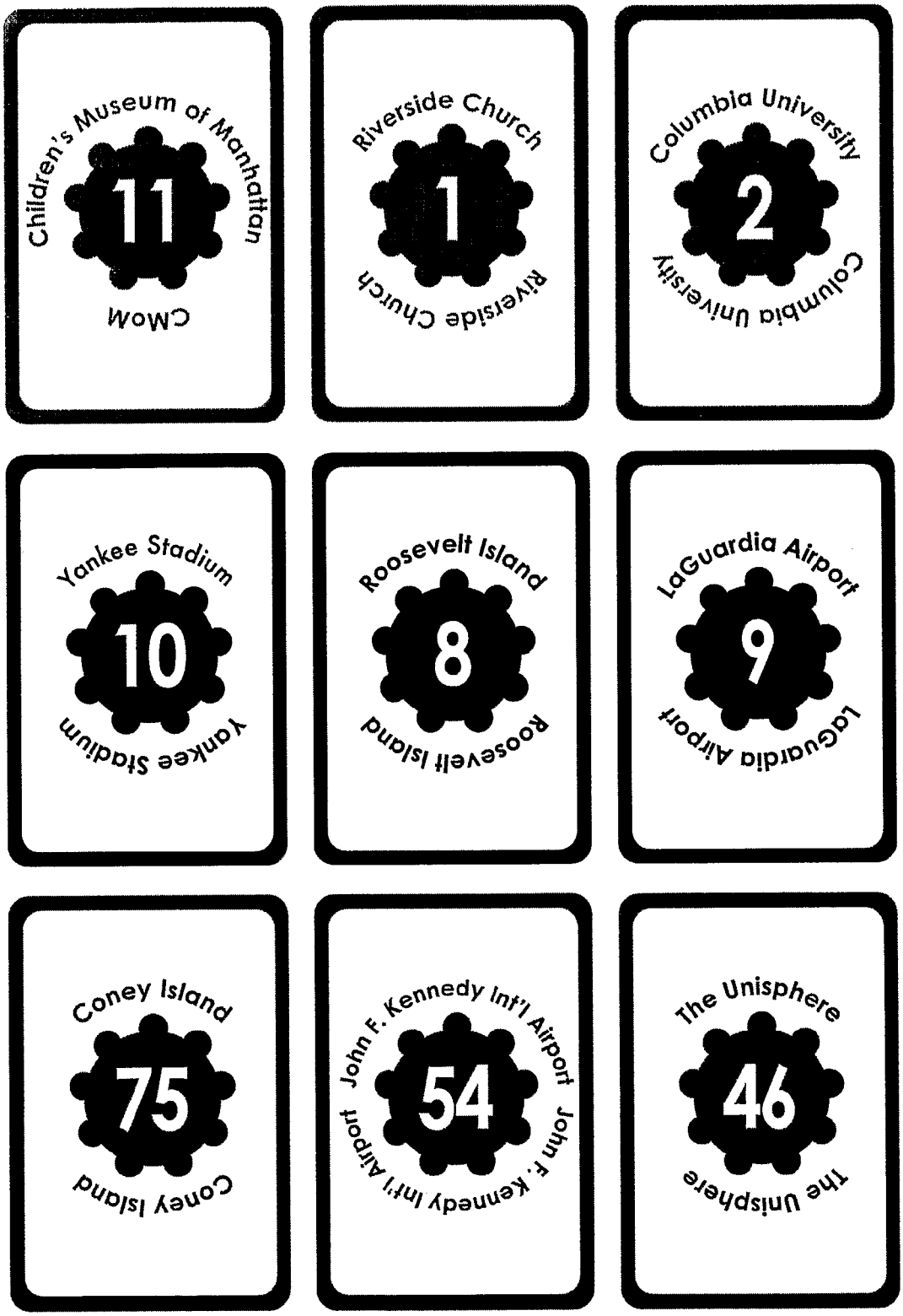
FIG. 14 is a display illustrating a plurality of destination target cards which may be used in playing another embodiment of the game of the present invention.
Figure 15:
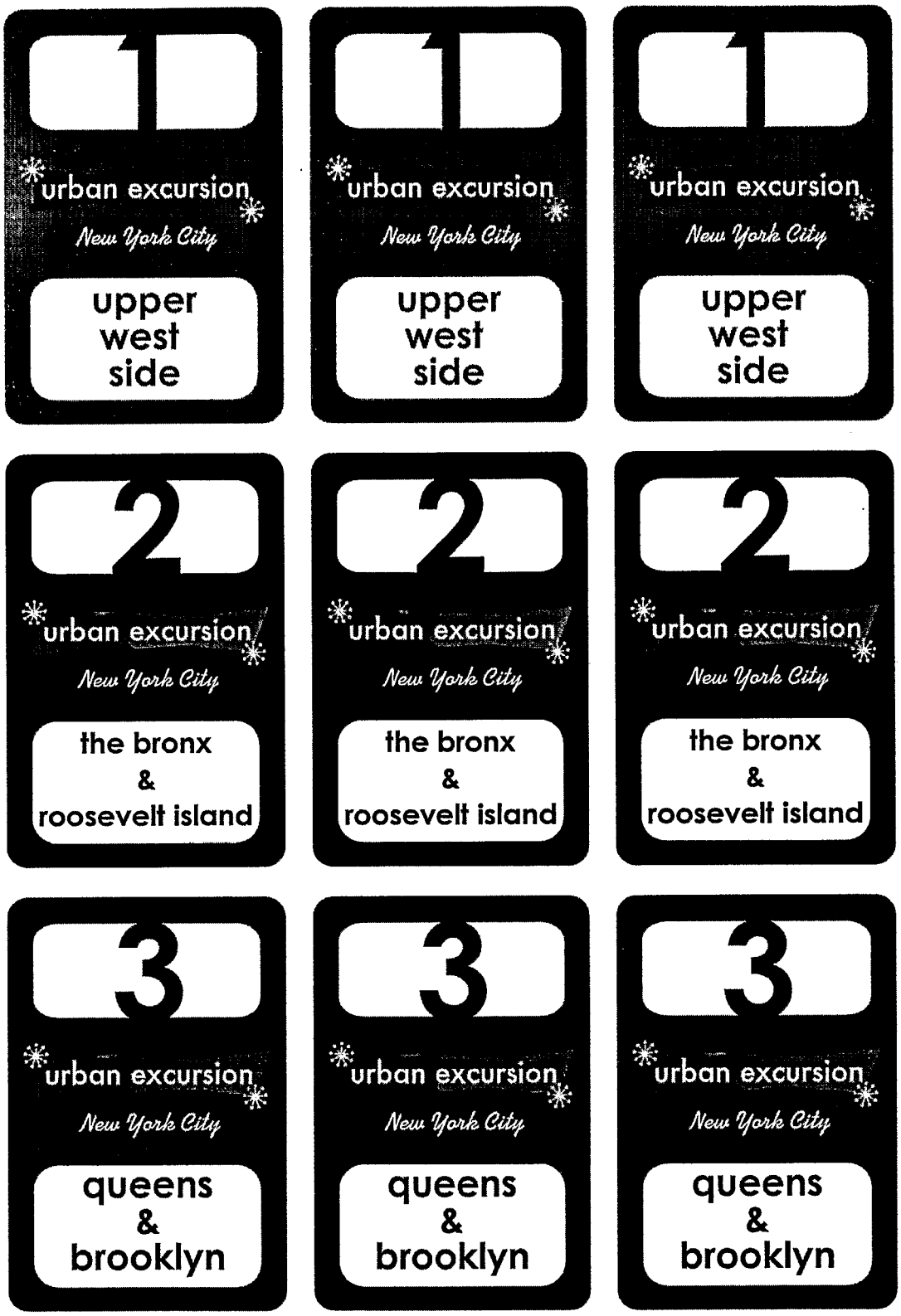
FIG. 15 is a layout illustrating cards which are used in playing yet a further embodiment of the present game.

As an additional modification to the Excursion game as set forth above there may be provided a pre-determined number of destination target cards, for example, 18 such cards may be utilized in one embodiment of this version of the game. Representative destination cards are illustrated in FIG. 14. This embodiment is referred to as Fixed Excursion. The back of these cards is illustrated in FIG. 15. The 18 points of interest on the destination target cards are placed in one of six groups according to their position on the game playing area and their distance from Times Square when utilizing the urban excursion New York City 2005. Each point of interest and each destination target group has been tripled to create a group of nine destination target cards. The Transportation Commissioner shuffles the nine destination target cards in each of the six destination target groups keeping the groups separate from one another. Players are then dealt one destination card from each of the six destination groups.

By play of the game in the manner above described the players must travel to all six of the points of interest found on the six destination cards which have been dealt to that player and claim a scoring card from each of the six destinations indicated on the target cards. When this has been accomplished, then the player will attempt to go to the finish line at Times Square, point of interest no. 34, as quickly as possible. The players may travel to the various six points of interest contained on the six destination target cards which they have been dealt in any order they choose and claim any one of the available scoring cards. If the utilization of a challenge card is used in this portion of the game and if a scoring card is lost through a challenge, then the player must visit another of the specified destinations before returning to claim a different scoring card. If the player claims the same scoring card again, whether by choice or necessity, the player gets the scoring card but the player's next turn is lost.

The first player to reach Times Square with six scoring cards from the points of interest on the destination target cards in the player's hand and then successfully claim a Times Square scoring card wins a game. If a player loses a challenge at Times Square, that player must travel to Hell's Kitchen, point of interest no. 29, before returning for another try at Times Square. If two players reach Times Square in the same turn, the value of all seven scoring cards are added together and the highest combination of values wins. A player who is waiting at Times Square for all other players to complete their final turn may challenge a player who arrives at Times Square during that turn. This player must put the Times Square scoring card at risk to challenge the claim of the newly-arrived opponent.

Figure 13:
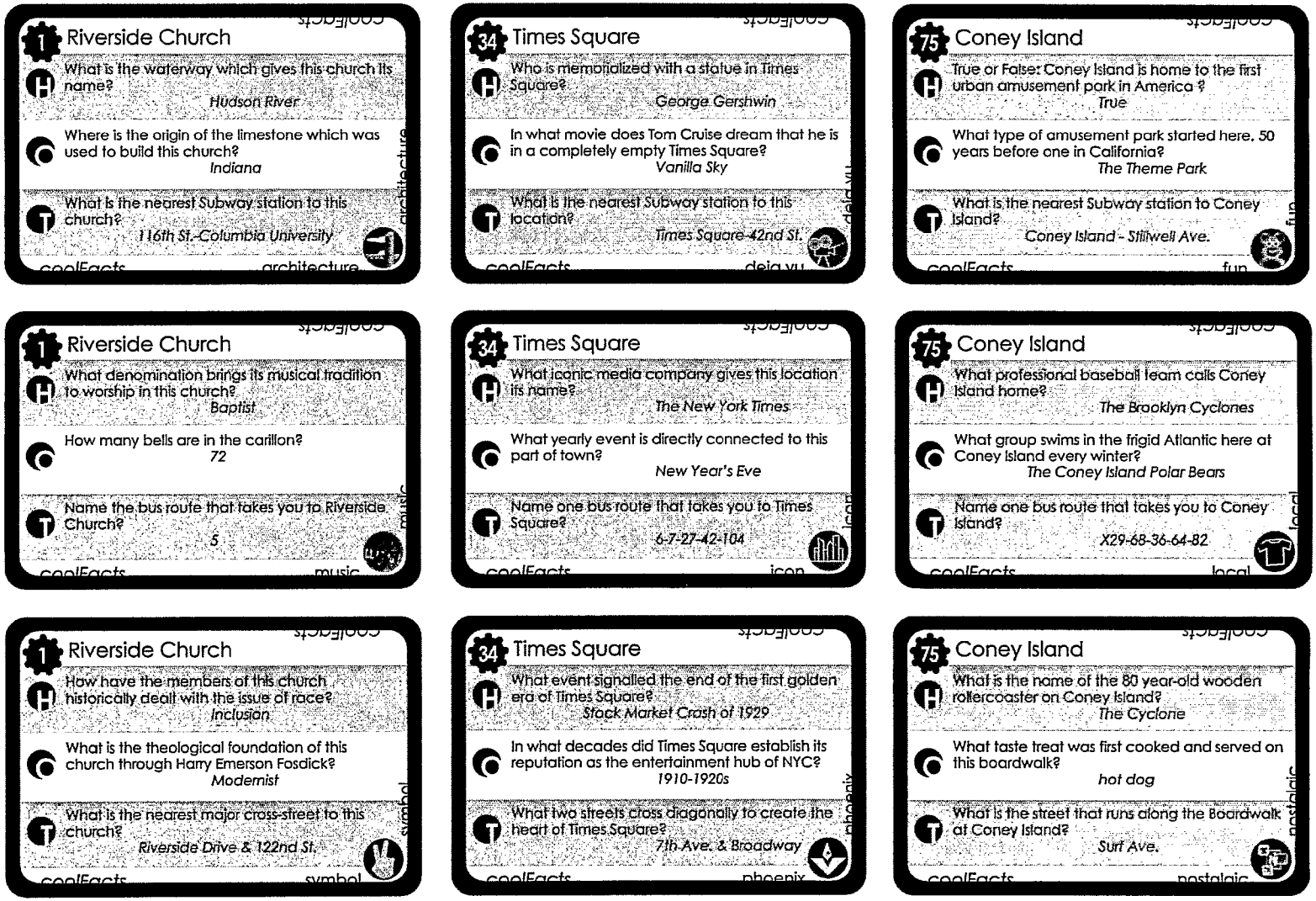
FIG. 13 is a display representative of additional scoring cards which are used in playing an alternative embodiment of the game of the present invention.

An additional embodiment of the Excursion Game is an embodiment referred to as CoolFacts Mode 1. In playing this embodiment of the game, there are provided travel theme logos which are small puzzles made up of three pieces: one of the pieces bears the letter "H", another of the pieces the letter "O" and the third of the pieces the letter "T." Such is illustrated in FIG. 13 to which reference is hereby made with respect to the Riverside Church point of interest 1, Times Square point of interest 34 and Coney Island point of interest 75. It will be understood that these are only representative and that such pieces would be available for selected others of the points of interest as illustrated on the map of FIG. 1.

The play of this embodiment of the game is the same as that identified and discussed above; however, there are no challenges available so the challenge card is eliminated from this embodiment of the game. In addition, players may not return to the same point of interest regardless of their success in claiming a scoring card the first time. On any additional visit to a previously visited point of interest, the player surrenders the scoring cards successfully claimed at the point of interest. If the player did not successfully claim a scoring card at the point of interest the first time, the player then surrenders one scoring card to the Transportation Commissioner and it is put back into play. In order to claim a scoring card, a player must answer at least one of three CoolFacts questions, which are available for each travel theme at each point of interest. The questions fall into three categories, namely, "Historical facts," "Obscure facts," and "Transportation facts." For example, reference to FIG. 13 with regard to the point of interest Times Square, the Historical fact is "Who is memorialized with a statue in Times Square?" and that namely is "George Gershwin." On the other hand, the Obscure fact would be "In what movie does Tom Cruise dream that he is in a completely empty Times Square?" The answer to that question is "Vanilla Sky." In addition, the Transportation fact with regard to Times Square is "What is the nearest subway station to this location?" That is "Times Square—42$^{nd}$ Street." Thus, when a player lands on point of interest 34, Times Square, the player will be asked those questions and must answer at least one of those questions for that point of interest in that travel theme to obtain a scoring card. Players must have a complete travel theme logo with an "H" section, an "O" section and a "T" section in order to score points for that travel theme at the end of the game. The player must also have three complete travel theme logos to legally leave town and end the game.

There are various modifications and additions which can be made to the CoolFacts embodiment of the game without departing from the spirit or principles of the game as above outlined and discussed.

There has thus been disclosed a game and a method of playing the same which is both entertaining and informative and which can provide educational information with regard to various geographical locations and points of interest situated therein which may be played by two to eight individuals or teams of individuals.

What is claimed is:

1. A game for play by a plurality of players comprising:

A. a board having a map defining a specific geographical area within which said game is to be played including a plurality of entrances and exits;

B. travel routes within said geographical area along which a player may move;

C. a plurality of nodes disposed at selected intersections and positions along each of said travel routes;

D. a plurality of points of interest associated with and disposed within said geographical area, each point of interest having a plurality of travel themes associated therewith;

E. a point of interest guide designating the location in the geographical area where a specific point of interest is located;

F. a travel theme guide designating those points of interest associated with a specific travel theme;

G. a plurality of transport resource cards for each player to select from to determine the mode of transport for use by that player in movement from node to node along a selected travel route by a player during a playing turn;

H. a random selection means for use in determining how far a player may move from node to node along a travel route during a playing turn; and I. a plurality of scoring cards associated with each point of interest, each of said scoring cards having a travel theme and scoring points assigned thereto, a scoring card being obtained by a player upon entry to a point of interest from an adjacent node.

2. A game as defined in claim 1 wherein said point of interest guide also identifies those specific travel themes associated with each of said points of interest.

3. A game as defined in claim 2 which further includes a plurality of playing pieces, one of which is to be used by each player playing the game to signify movement of that player along the travel routes from node to node identified on said map.

4. A game as defined in claim 3 in which said random selection means is a plurality of dice, the number of dice to be used during each playing turn is determined by the transport resource card selected by the player during that turn.

5. A game as defined in claim 1 which further includes a challenge card which may be utilized by a player having possession thereof to challenge another player to prevent said player from obtaining a scoring card at a particular point of interest.

6. A game as defined in claim 1 which further includes a guidebook containing an illustration and a narrative illustrating and describing each point of interest disposed within said area.

7. A game as defined in claim 1 wherein some of said plurality of nodes along said travel routes are designated as chance nodes and said game further includes a plurality of chance cards, one of which may be selected by a player moving onto a chance node during a playing turn.

8. A game as defined in claim 7 wherein said player may select a chance card only when the player moves the exact number of moves identified by said random selection means.

9. A game as defined in claim 8 wherein said chance cards include a mugging card, which enables a player having possession thereof to remove a transport resource card or scoring card from the possession of a fellow player.

10. A game as defined in claim 9 which includes a police stop card in said chance cards which may be used by a player having possession thereof to stop the play of any other player including a mugging.

11. A method of playing a game comprising the steps of:

A. providing a map of a specific geographical area over which players will travel;

B. providing means by which the players will travel;

C. providing routes along which players will travel, each route including a plurality of nodes at selected intersections and positions along said routes;

D. designating points of interest associated with and disposed within said specific geographical area and designating a plurality of travel themes for each point of interest;

E. providing a playing piece for use by each player to use in moving along said routes from node to node;

F. providing a point of interest guide designating the location in the geographical area where a specific point of interest is located;

G. providing a travel theme guide designating those points of interest associated with a specific travel theme;

H. selecting by chance the maximum distance a player can move along a route from one node to the next node on any one move;

I. entering a point of interest by moving the playing piece from a node adjacent the point of interest and collecting a scoring card associated with that point of interest having one travel theme associated therewith;

J. consulting said point of interest guide and said travel theme guide to determine the location of a different point of interest having the same travel theme as said one travel theme and moving said playing piece along selected ones of said routes from node to node to said different point of interest and collecting a scoring card associated with said different point of interest; and K. continuing to consult said point of interest guide and said travel theme guide and moving said playing piece to other points of interest to collect a predetermined number of scoring cards having different travel themes.

12. The method of playing a game as defined in claim 11 wherein said step of means by which the players will travel includes providing transportation resource cards identifying various methods of transportation and having the player select one of said transportation methods for a playing turn.

13. The method of playing a game as defined in claim 12 which further includes the step of providing each player with a right to challenge card which may be used to challenge a fellow player to prevent said player from obtaining a scoring card at a particular point of interest.

14. The method of playing a game as defined in claim 12 wherein said step of selecting by chance is accomplished by throwing up to three dice, the number of dice to be used being determined by the method of transportation selected by the player during a playing turn.

15. The method of playing a game as defined in claim 12 wherein said step of selecting by chance is accomplished by activating a spinner.

* * * * *